US006002415A

United States Patent [19]

Christy

[11] Patent Number: 6,002,415

[45] **Date of Patent: *Dec. 14, 1999**

[54] FIELD EFFECT IMAGING APPARATUS USING NON-CONDUCTIVE NON-MAGNETIC TONER

[75] Inventor: Orrin D. Christy, North Tonawanda, N.Y.

[73] Assignee: Moore Business Forms, Inc., Grand Island, N.Y.

[ * ] Notice: This patent is subject to a terminal disclaimer.

[21] Appl. No.: 08/906,806

[22] Filed: Aug. 6, 1997

Related U.S. Application Data

[62] Division of application No. 08/356,571, Dec. 15, 1994.

[51] Int. Cl.[6] ..... B41J 2/39; B41J 2/295; B41J 2/40; B41J 2/385

[52] U.S. Cl. ..... 347/151; 347/159

[58] Field of Search ..... 347/55, 154, 151, 347/159, 128, 120, 123, 141, 111, 17, 103, 124, 158, 224; 399/34, 71, 313, 46, 241, 293, 295, 291, 55

[56] References Cited

U.S. PATENT DOCUMENTS

| | | |
|---|---|---|
| 3,816,840 | 6/1974 | Kotz . |
| 4,402,000 | 8/1983 | Fabel et al. . |
| 4,464,672 | 8/1984 | Lindahl . |
| 4,544,935 | 10/1985 | Sakai . |
| 4,620,203 | 10/1986 | Nakatani et al. . |
| 4,729,310 | 3/1988 | Love, III . |
| 4,763,143 | 8/1988 | Ohba et al. . |
| 4,777,499 | 10/1988 | Okuna et al. . |
| 4,810,604 | 3/1989 | Schmidlin . |
| 4,855,763 | 8/1989 | Kan . |
| 4,855,768 | 8/1989 | Iino et al. . |
| 4,860,036 | 8/1989 | Schmidlin . |
| 4,876,561 | 10/1989 | Schmidlin . |
| 4,903,050 | 2/1990 | Schmidlin . |
| 4,949,103 | 8/1990 | Schmidlin et al. . |
| 4,977,415 | 12/1990 | Oba et al. . |
| 5,115,759 | 5/1992 | Kagayama . |
| 5,132,708 | 7/1992 | Schmidlin et al. . |
| 5,187,523 | 2/1993 | Osawa . |
| 5,231,427 | 7/1993 | Ohashi . |
| 5,253,022 | 10/1993 | Takeuchi et al. . |
| 5,257,046 | 10/1993 | Schmidlin . |
| 5,291,254 | 3/1994 | Shimada et al. . |
| 5,406,314 | 4/1995 | Kuehnle . |
| 5,422,214 | 6/1995 | Akiyama et al. . |
| 5,883,656 | 3/1999 | Christy ..... 347/151 |

FOREIGN PATENT DOCUMENTS

| | | |
|---|---|---|
| 0 494 454 a2 | 7/1992 | European Pat. Off. . |
| 2 084 934 | 4/1982 | United Kingdom . |

*Primary Examiner*—John Barlow
*Assistant Examiner*—Raquel Yvette Gordon
*Attorney, Agent, or Firm*—Nixon & Vanderhye P.C.

[57] ABSTRACT

A method and apparatus are provided for "field effect imaging" of moving substrates, such as webs of paper. Non-conductive, non-magnetic toner having approximately a 5–20 micron mean particle size is electrically charged to a level of at least about 8 micro Coulombs/gram and then a first roller with a conductive surface is brought into operative association with the electrically charged toner so that toner particles adhere to the surface. The toner particles are preferably maintained in an electrostatic fluidized bed, and charged by a corona element in the bed. An array of pin or stylus primary electrodes are selectively energized or de-energized to provide no-write or write condition, respectively using a computer to switch the electrodes into or out of operative connection to a source of electrical potential. The toner particles are transferred from the first roller to a substrate either directly (after passing past the primary electrodes), or they are first transferred to a second roller which then brings the toner particles into contact with the substrate. If a second roller is utilized, the primary electrodes can be in association with the first roller, or between the first and second rollers for transferring only "write" toner to the second roller.

18 Claims, 9 Drawing Sheets

FIELD EFFECT IMAGING APPARATUS USING NON-CONDUCTIVE NON-MAGNETIC TONER

This is a divisional of application Ser. No. 08/356,571, filed Dec. 15, 1994.

BACKGROUND AND SUMMARY OF THE INVENTION

Commercial non-impact printing systems typically use a method of developing toner (liquid or dry powder) to an electric or magnetic latent image created by some writing means. Generally associated with the creation of the latent image are an imaging cylinder, some means for creating the image, and associated conditioning means for residual image removal and cleaning. All of these components wear out during system operation and must be added to the cost of each printed page. Toner itself costs somewhere (in 1994) in the neighborhood of \$0.0006 to \$0.001 per page. Adding in the rest of the consumable components, the cost is raised to a range of \$0.0625 to \$0.0065 per page. Latent image non-impact printing carries a considerable additional imaging cost. Direct-to-paper imaging systems such as ink jet technologies carry only the cost of the ink; however, many of these technologies do not obtain imaging as desirable or quick or versatile as latent image systems do.

Another technology that is not commercial but attempts to obtain direct-to-paper imaging (that is without a latent image) is the magnetstylus technology, exemplified by U.S. Pat. Nos. 3,816,840, 4,402,000, and 4,464,672. This technology uses a dry, magnetically attractable, electronically conductive toner which forms a connecting path from the primary to the secondary electrode. The "write" condition of the toner is the active electrode condition and extra toner is removed by a magnetic field. Typically inductive charging of the toner for the "write" condition is used, and the secondary electrode uses a dielectric receptor material above it. This technology has not become commercial, however, primarily due to imaging and background removal problems, as well as problems with transferring the toner to a substrate.

Another proposed technology for direct-to-paper imaging is called direct electrostatic printing (DEP), and is exemplified by U.S. Pat. Nos. 4,860,036 and 4,810,604. This technology typically utilizes some sort of a toner conveyor which moves the toner past the primary electrodes formed by multiple apertures, with an electrically insulated base member clad on one side thereof with a continuous conductive layer of metal, and on the opposite side a segmented conductive layer. Toner passes through the apertures into a web which is moving past a stationary backing electrode or shoe which can be connected up to potential sources to either effect printing or cleaning operations. The toner delivery systems in DEP technology leaves much to be desired, and the dual conductive apertures spaced apart from each other by an insulating member are more complex than is desired.

According to the present invention a method and apparatus are provided which are able to achieve direct-to-paper imaging (that is without a latent image) in a simple yet effective manner. The technology of the present invention may be referred to as "field effect imaging". The invention utilizes non-conductive, non-magnetic toner which does not form a connecting path from the primary to secondary electrodes, has the "write" condition when the primary electrode is de-energized, removes extra toner with an electric field, does not use inductive charging of the toner for the "write" condition, and uses simple primary electrodes, typically pin or stylus simple electrodes disposed in an array. In the field effect method only the electrostatic adhesion force dominates in control of the toner on a "secondary electrode" (typically a conductive surface which can be either positively or negatively charged, or grounded, such as a roller with a conductive surface), and imaging is subtractive in nature (that is the toner in the non-image areas is removed by the primary electrodes).

According to one aspect of the present invention, a method of applying a toner image to a moving substrate (typically paper web), using a non-conductive, non-magnetic toner having a 5–20 micron mean particle size, at least a first moving conductive member, and an array of primary electrodes, is provided. The method comprises the steps of substantially consecutively and continuously: (a) Electrically charging the non-conductive, non-magnetic toner having a 5–20 micron mean particle size to a level of at least about 8 micro Coulombs/gram. (b) Bringing the first moving conducting member into operative association with the electrically charged toner from step (a) so that toner particles adhere thereto, forming a layer thereon. (c) Selectively energizing individual primary electrodes from the array of primary electrodes to cause them to apply electric fields to the layer of toner particles in a no-write condition to effect removal of toner particles where the applied electric field exists at a level greater than an electrostatic adhesion force on the toner particles in the layer, the applied electric field times the charge on the toner being greater than $Q^2/(16*\Pi*\epsilon_0*r^2)$, where Q is the charge on the toner, $\epsilon_0$ is the permitivity constant, and r is the toner particle radius; or selectively de-energizing individual primary electrodes from the array of primary electrodes to cause them not to apply electric fields to the layer of toner particles in a write condition, in which the layer of toner particles merely passes past the array of primary electrodes without toner particles being removed from the layer. (d) Transferring the toner particles remaining on the first conductive member after it passes past the array of primary electrodes to the moving substrate. And, (e) fusing the toner particles to the substrate.

Step (c) is typically practiced to apply an electric field of greater than about 1.6 volts/$\mu$M when in the no-write condition. Step (c) is typically further practiced so that the magnitude of the electric field applied in the no-write condition is equal to $(V_1-V_2)/D$, where $V_1$=the electric potential of the primary electrode, $V_2$=the electric potential on the first conductive surface, and D=the separation distance between the primary electrode and the first conductive surface, D=about 75–250 microns.

Typically the toner is in an electrostatic fluidized bed during the practice of step (a), such as shown in European published patent application 494454, and the first surface is moved past the fluidized bed in the practice of step (b), and the toner removed in the no-write condition during the practice of step (c) returns to the fluidized bed. Preferably the primary electrodes are pins or styluses, and the first conductive surface is the exterior surface of the first roller. In that case step (d) is practiced by bringing the exterior surface of the first roller into contact with the moving substrate and by applying a transfer electrical force (e.g. using a transfer corona on the opposite side of the moving web of paper from the roller) to the toner on the exterior surface of the first roller to cause the toner to transfer from a first roller to the substrate. Alternatively a second roller may also be provided having a second conductive exterior surface, in which case step (d) may be practiced by electrically transferring the toner from the first roller to the second roller, and then bringing the exterior surface of the second roller into contact with the moving substrate, and by applying a transfer electrical force to the toner on the exterior surface of the second roller to cause the toner to transfer from the second roller to the substrate. Step (c) may be practiced by utilizing the primary electrode disposed between the first and second rollers, or associated with the first roller remote from the second roller. Where two rollers are utilized, premature transfer of toner from the first roller to the second roller may be provided by shielding the rollers from each other remote from the area of closest proximity between them.

Step (c) is typically practiced by electronic switching of the connection of each primary electrode pin or stylus of the array to a source of electrical potential, by controlling electronic switches using a computer. A flow shield may also be provided mounted just "downstream" of the primary electrode array in the direction of movement of the first roller to cause the toner particles removed from the first roller to fall by gravity into the fluidized bed below it.

According to another aspect of the present invention a field effect imaging apparatus is provided which comprises the following elements: An electrostatic fluidized bed of non-conductive, non-magnetic toner particles. Means for mounting a moving substrate on which toner is to be applied. Means for electrically charging toner particles in the fluidized bed. A first roller having a conductive outer surface mounted for rotation adjacent the fluidized bed to receive charged toner particles from the fluidized bed in a layer on the surface thereof. An array of primary electrodes. Means for selectively applying electrical potential, or no electrical potential, to the individual primary electrodes depending upon whether a no-write or write condition is the exist. And, means for transferring toner from the first roller to a moving substrate mounted by the means for mounting a moving substrate.

The array preferably comprises an array of pin or stylus electrodes and the array may either be mounted adjacent but spaced from the first roller and between the fluidized bed and the substrate (in which case the toner transferring means transfers toner from the first roller directly to the moving substrate), or a second roller may be provided between the first roller and the substrate. In this case the primary electrodes may either be associated with the first electrode, or may be disposed between the rollers so that only the "write" toner is transferred from the first roller to the second roller.

The array pins or styluses may be mounted so that they are spaced about 75–250 microns from the first roller, or from between the rollers. A flow shield for causing toner removed by the no-write conditions of the primary electrodes to fall back into the fluidized bed may be provided as well as a shield between the first and second rollers. The means for electrically charging toner particles in the fluidized bed may be a rotating cylinder with a plurality of corona points, or a corona wire, immersed in the fluidized bed.

According to another aspect of the present invention a field effect imaging apparatus is provided comprising the following elements: Means for mounting a moving substrate. A source of charged toner particles. A first roller having a conductive outer surface mounted for rotation adjacent the source to receive charged toner particles from the source in a layer on the surface thereof. An array of pin or stylus primary electrodes. Means for selectively applying electrical potential, or no electrical potential, to the individual pin or stylus primary electrodes depending upon whether a no-write or write condition is the exist. And, means for transferring toner from the first roller to a moving substrate mounted by the means for mounting a moving substrate.

The first roller conductive exterior surface may be coated with or comprise a conductive hard metal coating; for example it may be coated with hard chrome, tungsten carbide, silicon carbide, or Diamond-Like Nanocomposite.

It is the primary object of the present invention to provide a simple yet effective direct-to-paper imaging system and method. The "direct writing" field effect toning method and apparatus of the invention have no latent image to deal with, the rollers utilized are conductive with hardened surfaces that need no particular conditioning, the imaging (primary) electrode array contains no wearing parts and is not in contact with any moving surfaces, and in general the only consumable is the toner itself. This and other objects of the invention will become clear from an inspection of the detailed description of the invention, and from the appended claims.

DETAILED DESCRIPTION OF THE DRAWINGS

Figure 1A:
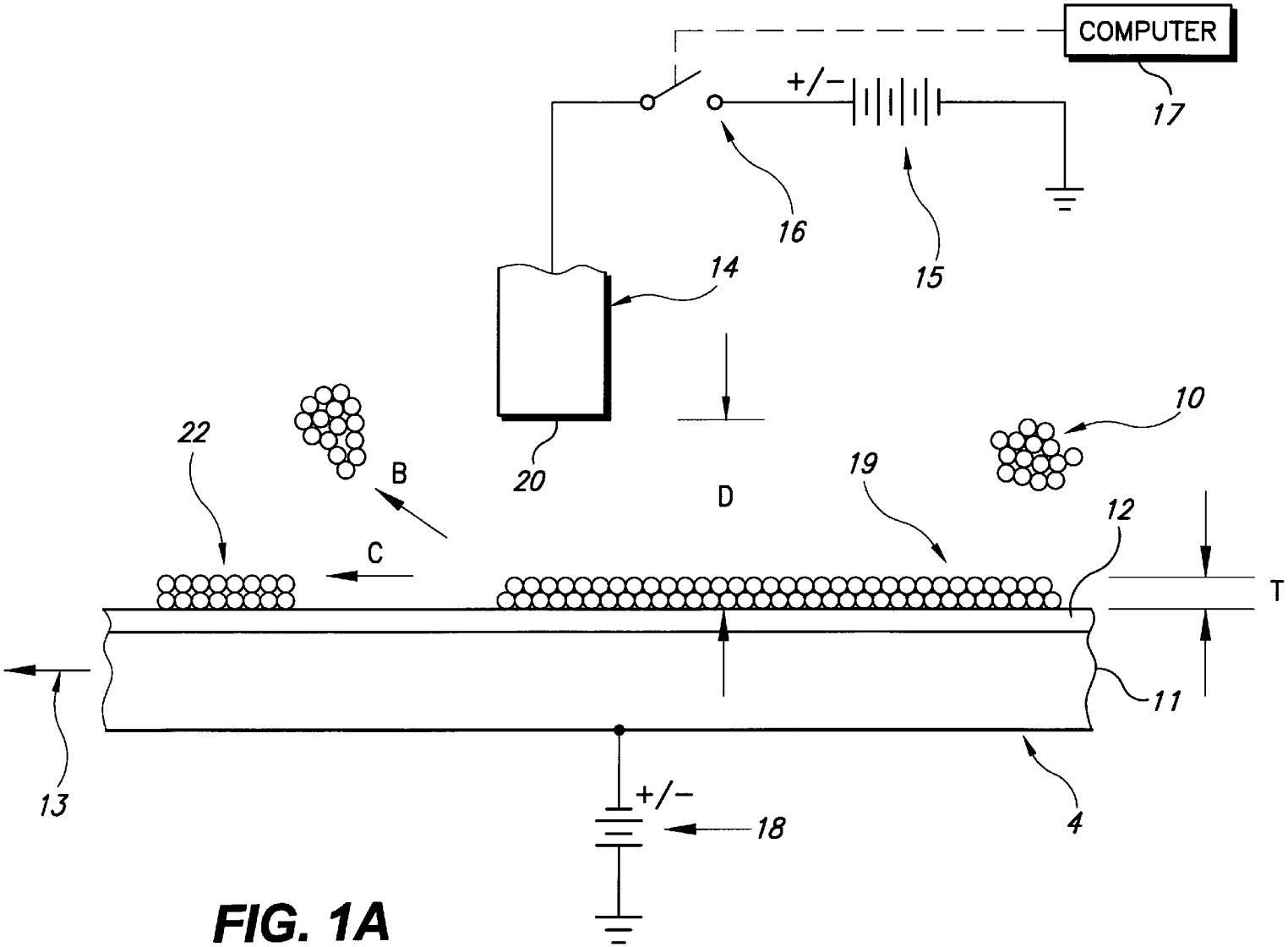
FIG. 1A is a schematic side view showing operation of the field effect toning apparatus and method according to the invention.
Figure 1B:
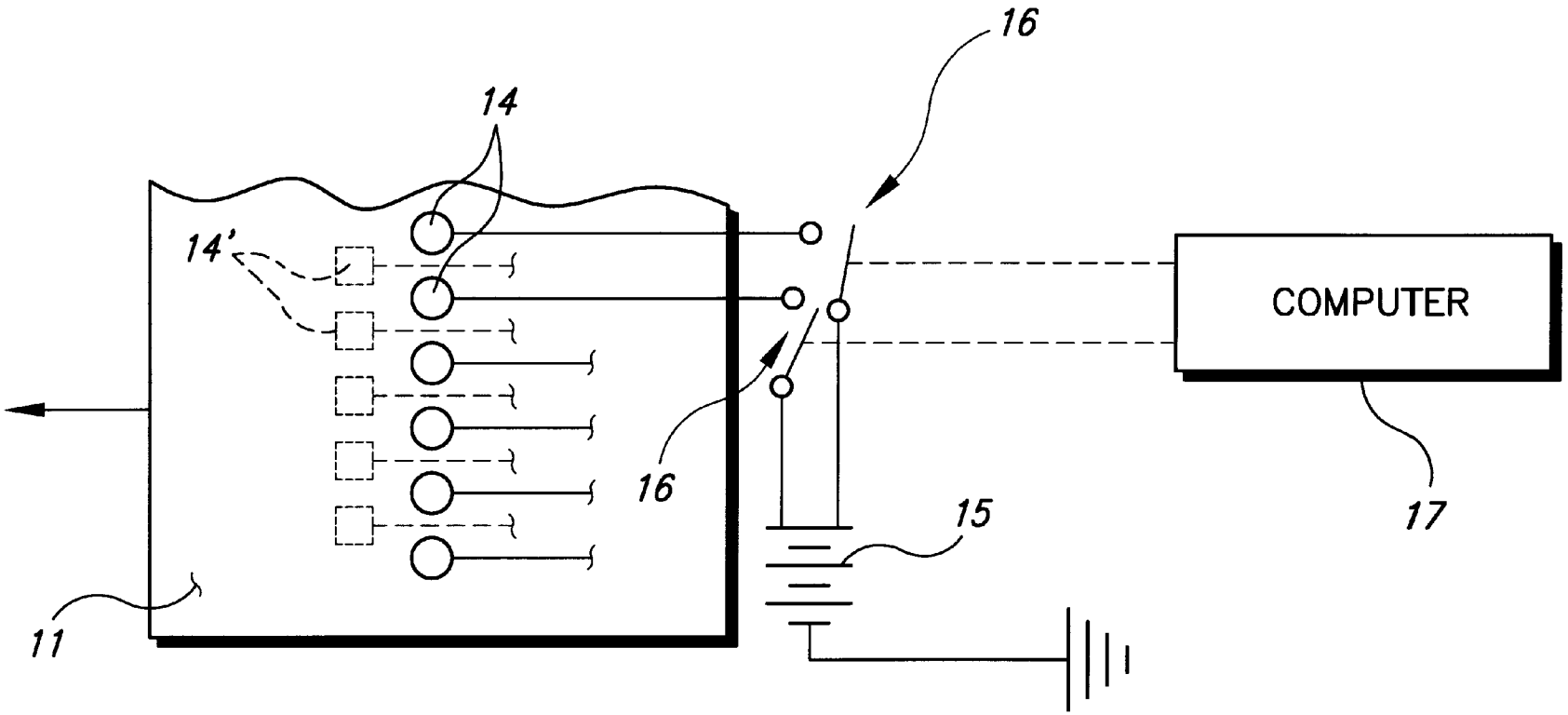
FIG. 1B is a schematic top view of the apparatus of FIG. 1A.

FIGS. 1A and 1B are designed to illustrate the basic principles of the field effect toning technology according to the present invention. The basic elements of the apparatus comprise a toner supply (a non-conductive, non-magnetic toner) shown schematically by reference numeral 10, a moving conductive substrate 11, which may have a particularly hard conductive coating 12 thereon (e.g. formed of hard chrome, tungsten carbide, silicon carbide, or Diamond-Like Nanocomposite) which moves in the direction 13, and an array of primary electrodes 14 of conductive material which can be electrically biased into the "write/no-write" condition by utilizing voltage source 15 and high speed switching circuitry 16 which is controlled by a computer 17. Only one electrode 14 is illustrated in FIG. 1A, but the array-like nature of the electrodes is illustrated in FIG. 1B. The electrodes 14 may be in a single line in the array as shown in solid line in FIG. 1B, or may be disposed in a two dimensional array, as indicated when the dotted line electrodes 14' from FIG. 1B are considered. FIG. 1B only shows two of the electrodes 14 connected up to electronic switches 16, but it is to be understood that all will be connected to the source of electric potential 15 through an electronic switch 16.

The conductive surface 11, which may be considered a secondary electrode, can be biased to either electrical polarity by a voltage source 18, or held at electrical ground depending upon the particular application. The outer surface of the coating 12 is ground and polished to a surface roughness of four micro inches rms or better.

The toner layer 19 which is deposited on the surface 11, 12 typically has a thickness T; normally the layer 19 is a bi-layer of toner with a thickness of about 20 microns. The preferred mean particle size diameter of the toner is about 10.5 microns, however the process is workable with toners from about 5–20 microns mean particle size. The toner in layer 19 is typically charged to a level of at least 8 $\mu$C/gm (either positive or negative), and more typically to 10 $\mu$C/gm charged to mass ratio by field charging (Panthenier charging) utilizing a high voltage corona source. That is the voltage supplied is on the order of about 7 kV.

The primary electrodes 14 can be of any number of cross-sectional shapes, such as the round shapes illustrated in solid line in FIG. 1B, or the flat polygonal (e.g. quadrate) shapes illustrated at 14' in dotted line in FIG. 1B. The face 20 of each electrode 14—which preferably is in the form of a pin or stylus, as illustrated schematically in FIGS. 1A and 1B—is mounted spaced a distance D from the surface 11, 12. The preferred distance D is about 75–250 microns, and during operation no electrical path is created by the toner between the electrode 14 and the surface/electrode 11, 12.

The electrode 14 is energized in the no-write condition, and when energized the toner particles within the influence of the field generated by the electrode 14 "jump" off the surface 11, 12 (the electric field force on the toner particles having exceeded the electrostatic adhesion force) as indicated at B in FIG. 1A. The toner image 22, which passes under the array of electrodes 14 when in the "write" condition, passes on as indicated by the directional arrow C to the transfer position where the image is transferred to the substrate and fused by conventional means (e.g. heating). In the "no-write" condition, a primary electrode 14 is switched to the bias level provided by voltage source 15. This forms an electric field between the primary and secondary electrodes. The field is of magnitude, $$E=(V_1-V_2)/D$$

where $V_1$ is the potential on the primary electrode 14, $V_2$ is the potential on the secondary electrode (11, 12) and D is the separation distance between the electrodes. The toner layer 19 is separated from the secondary electrode 11/12 under this condition when the electric field force on the toner particles exceeds the electrostatic adhesion force, that is $$F_E>F_{ad}$$

or $$Q*E>Q^2/(4*\Pi*\epsilon_0*r^2)$$

to a first order approximation. Q is the charge on the toner, $\epsilon_0$ is the permitivity constant, and r is the toner particle radius. Separated particles B are removed from the surface by electric fields only and are recycled to the toner source 10 (e.g. the electrostatic fluidized bed).

In the "write" condition, the electrode 14 bias 15 is turned off by computer 17 control of switch 16, allowing the toner image 22 to pass on and be directed to the transfer position where the image is transferred to the substrate (not shown in FIGS. 1A and 1B) and fused by conventional means.

Figure 2:
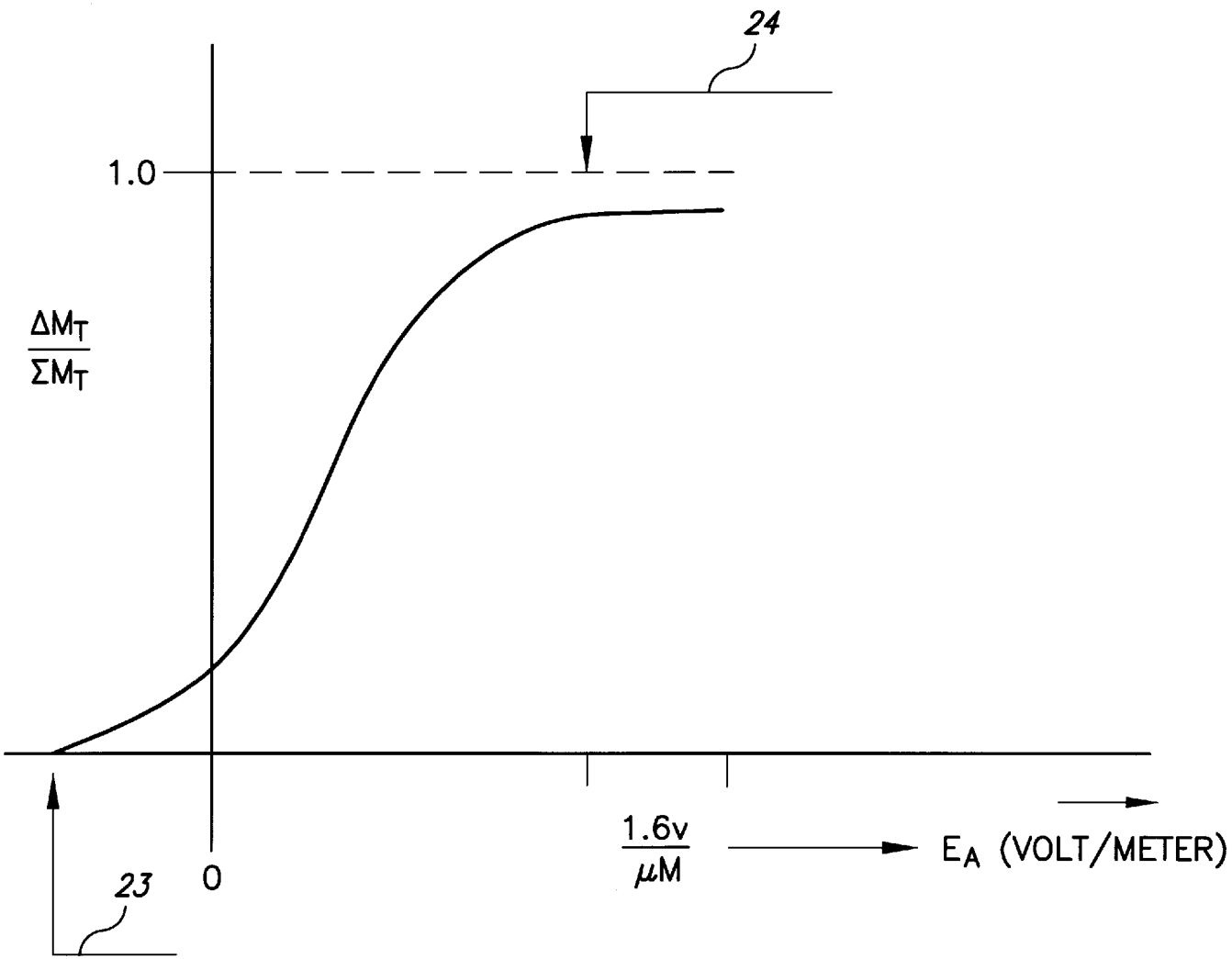
FIG. 2 is a graphical representation illustrating the percentage of toner released under the influence of a primary electrode according to the invention, with increasing applied electric field.

Since the toner supply 10 will in actuality comprise a large population of particles which vary in size and therefore overall amount of charge, not all of the particles will be released from the surface 11, 12 with the same applied electric field. With the varying charges and equivalent diameters, there is a range in electric field magnitude over which the particles are released from the surface 11, 12, and FIG. 2 schematically illustrates a typical plot of the percentage of toner released with increasingly applied electrical field. Transfer of toner begins at a low threshold field 23 and continues until the entire population is transferred after passing a total transfer field magnitude 24. In practice, this is not total transfer, but amounts to about 95%, probably due to some very low charged or wrong charge toner particles. To assure a total transfer of toner between the surfaces 14, 11/12 of FIGS. 1A and 1B, the electric field should exceed the total transfer magnitude 24 by some nominal amount. In practice the total transfer magnitude is about 1.6 volts/$\mu$M. Therefore electric fields greater than this must be utilized, and in actual practice fields within the range of about 2.2–2.4 volts/$\mu$M are utilized.

Figure 3:
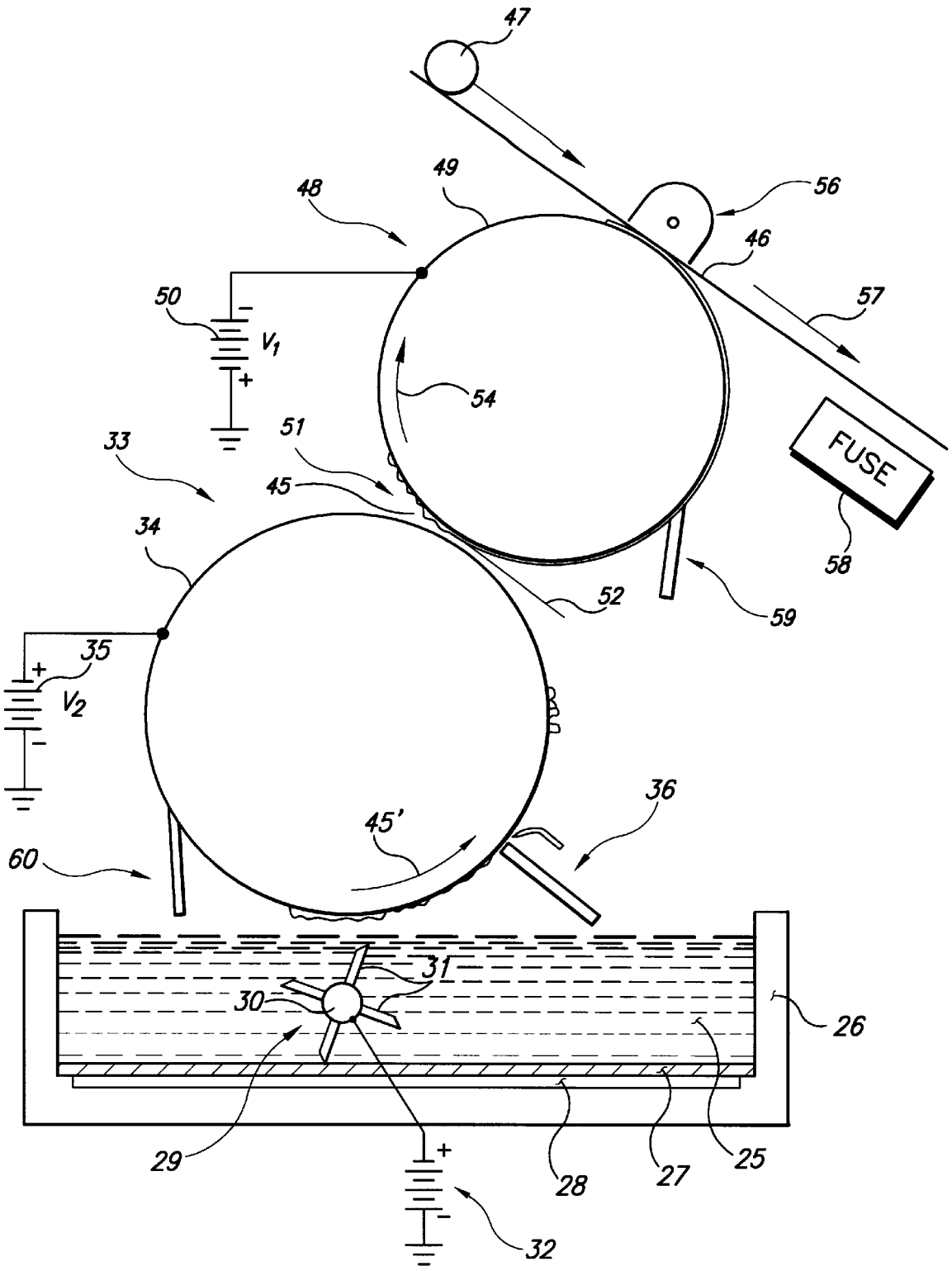
FIG. 3 is a side schematic view of a preferred embodiment of exemplary apparatus according to the present invention.
Figure 4:
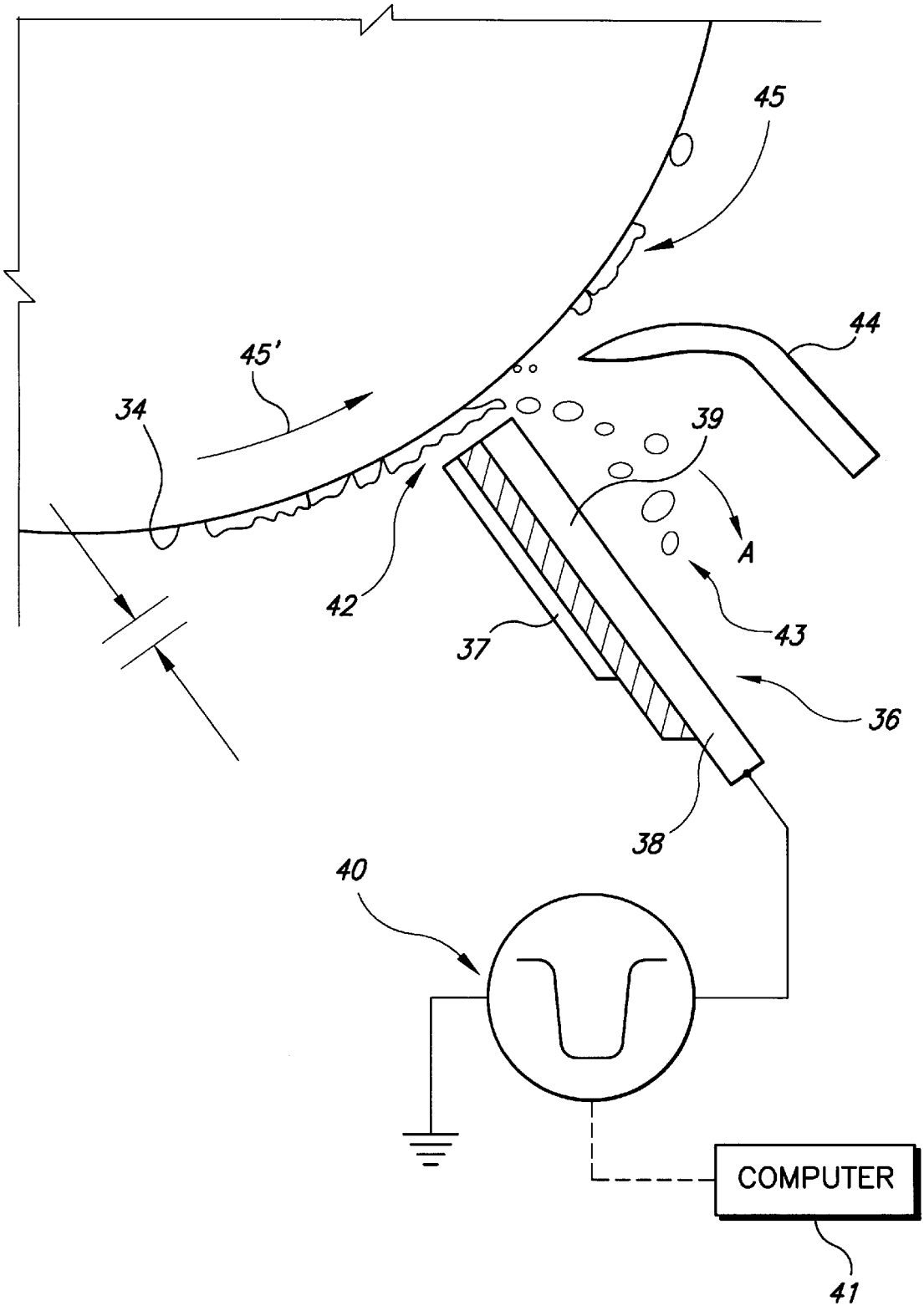
FIG. 4 is a side detail view of the primary electrode portion of the apparatus of FIG. 3.

FIGS. 3 and 4 schematically illustrate a preferred apparatus utilizing the basic field effect toning principle illustrated in FIGS. 1 and 2. In this embodiment the source of toner comprises a fluidized bed 25 of toner particles (e.g. having an about 5–20 micron mean particle size), being disposed within the container 26 and having a porous plate 27 through which fluidizing air passes, being supplied from the air plenum 28. Means are provided for electrically charging the toner particles in the bed 25. Such means are illustrated schematically at 29 in FIG. 3 and comprise a cylinder 30 which rotates within the bed 25 and has corona points (e.g. four equally spaced arrays of points) around the surface thereof. Alternatively such means may comprise a corona wire, or any other suitable mechanism for imparting a charge to the non-conductive, non-magnetic toner particles within the bed 25. The electrical charging means 29 are connected up to a source of electrical potential illustrated schematically at 32 in FIG. 3.

Disposed above the bed 25 is a first roller 33 having a conductive surface 34. The roller 33 may be connected up to a source of electrical potential 35 (either a positive or negative source) or may be electrically grounded. It is typically mounted for rotation about a horizontal axis and powered by a conventional motor. In operative association therewith is an array of primary electrodes illustrated schematically at 36 in FIG. 3. The array 36 corresponds to the primary electrodes 14, 14' of the array illustrated in FIGS. 1A and 1B, while the roller surface 34 corresponds to the surface 11/12 in FIG. 1A.

The primary electrodes 36 are shown in more detail in FIG. 4. Each electrode 36 typically comprises a biased shield plate 37, an insulating layer 38, and an array of conductive pins or styluses 39. The pins 39 are connected up to a negative pulse electronic switch 40 controlled a computer 41. There is a gap 42, with dimension "d" in FIG. 4, typically about 75–250 microns, between the surface 34 and the closest surfaces of the pins 39.

When the computer 41 energizes a pin 39 through the electronic switch 40 associated therewith, toner particles, as indicated schematically at 43 in FIG. 4, are caused to "jump" from the surface 34. This "no-write" condition essentially removes the "background" areas of the toner on the surface 34 and returns the toner particles forming them to the fluidized bed 25, which is just below the electrodes 36. If desired a flow shield 44 or the like is provided "downstream" of the primary electrodes 36 in the direction 45' of rotation of the roller 33 to help return the removed toner 43 to the fluidized bed 25.

After the toner on the roller 33 passes past the primary electrodes 36, there will be only image (or what will become image) areas 45 on the surface 34. These image toner areas 45 must then be transferred to a moving substrate 46 (see FIG. 3), such as a paper web. The substrate 46 is mounted by rollers, such as the roller 47, or other conventional equipment for moving a web past and into contact with a rotating cylinder.

In the embodiment illustrated in FIG. 3, transfer of the image areas 45 is accomplished utilizing a second roller or cylinder 48 having a conductive exterior surface 49. The roller 48 is also typically connected up to a source of electrical potential such as a source 50 illustrated schematically in FIG. 3. The roller 48 is mounted for rotation about an axis parallel to the axis of rotation of the roller 33, and they are so mounted that the transfer point 51 therebetween is a small gap at which the surfaces 49, 34 are in close proximity.

In order to preclude premature transfer of the toner images 45 from the surface 34 to the surface 49 in the weak fields as the toner images 45 approach the closest proximity area 51, an electrical shield 52 is provided between the images 45 as they move in direction 45' toward the gap 51.

The cylinder 48 is rotated in a direction 54 that is opposite to the direction 45'. At the transfer area 51 where the rollers 48, 33 are in closest proximity, the same electrical forces are applied as indicated earlier, causing the image toner 45 to transfer from the surface 34 to the surface 49. The roller 48 then rotates clockwise to a contact point with the paper web 46 where a transfer means—such as the conventional transfer corona 56 on the opposite side of the substrate 46 from the roller 48—effects transfer of the toner images from roller 48 to the web 46. The web 46 then continues to move in the direction 57 to a conventional fuser 58 (e.g. which applies heat to the toner), which fuses the toner to the substrate 46.

In order to remove excess toner from the cylinders 33, 48, conventional scrapers 59, 60 are provided, the removed toner falling under the force of gravity into the fluidized bed 25.

Figure 5:
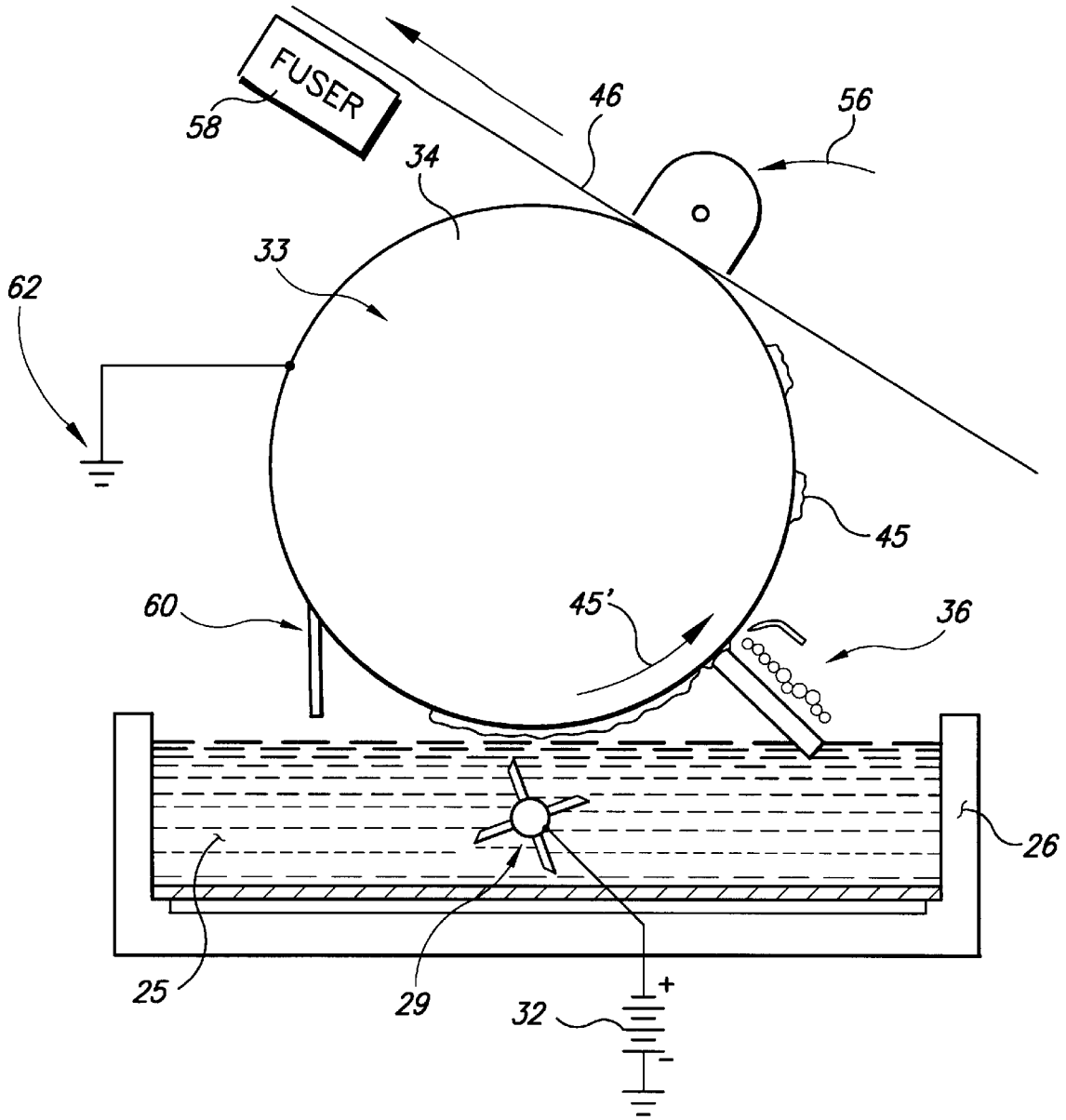
FIG. 5 is a view like that of FIG. 3 for another embodiment of apparatus according to the invention.

FIG. 5 illustrates another exemplary embodiment according to this invention. In FIG. 5, components comparable to those of the FIGS. 3 and 4 embodiment are shown by the same reference numeral. This embodiment differs from the embodiment of FIGS. 3 and 4 only in that the single roller 33 is provided, and the toner images 45 on the surface 34 thereof are brought directly into contact with the moving substrate 46 (which moves in the opposite direction of that illustrated in FIG. 3). Also, in this particular situation the roller 33 is connected to ground, as indicated schematically at 62, rather than to a source of electrical potential.

Figure 6:
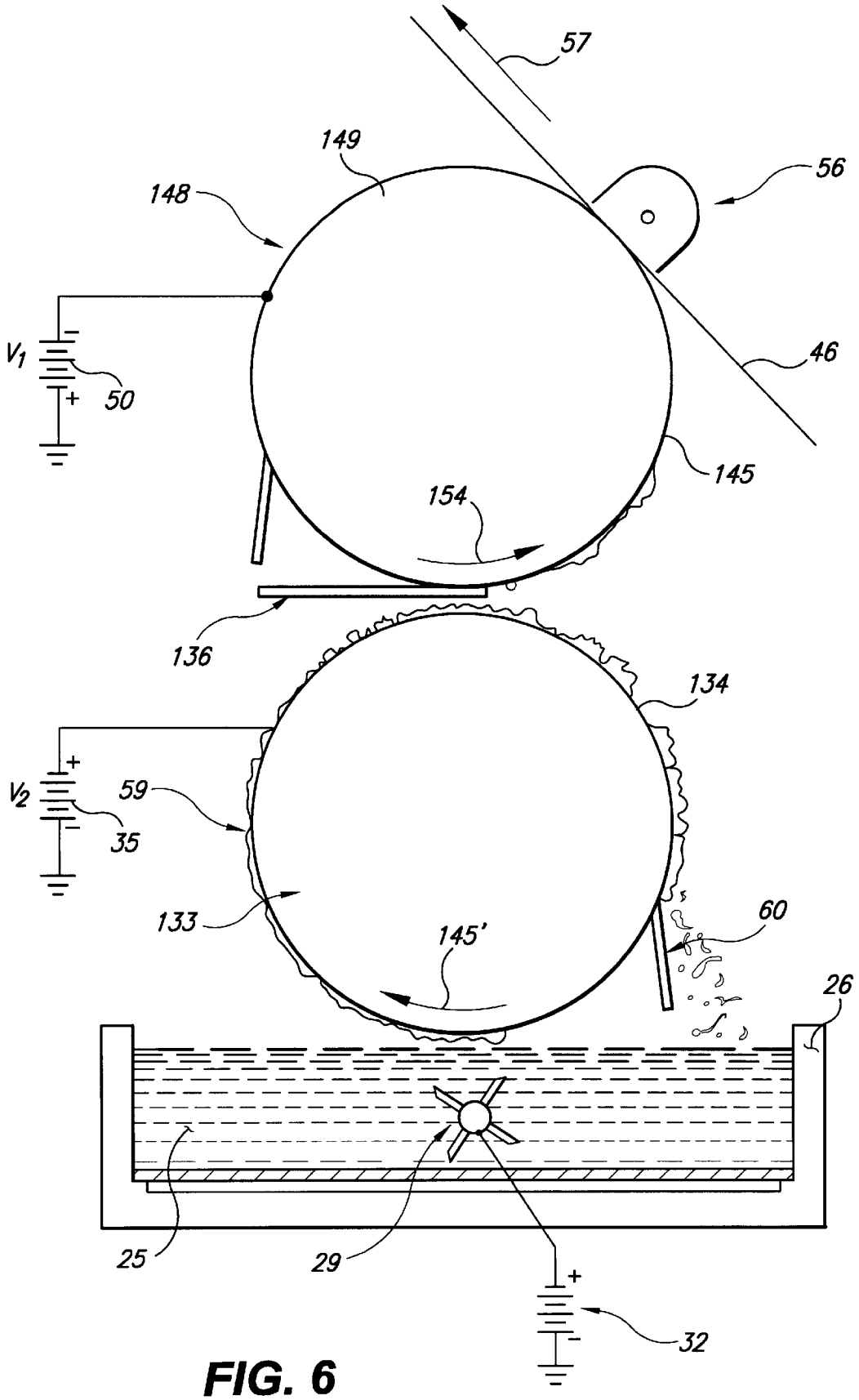
FIG. 6 is a view like that of FIG. 3 for still another embodiment of the apparatus according to the present invention.
Figure 7:
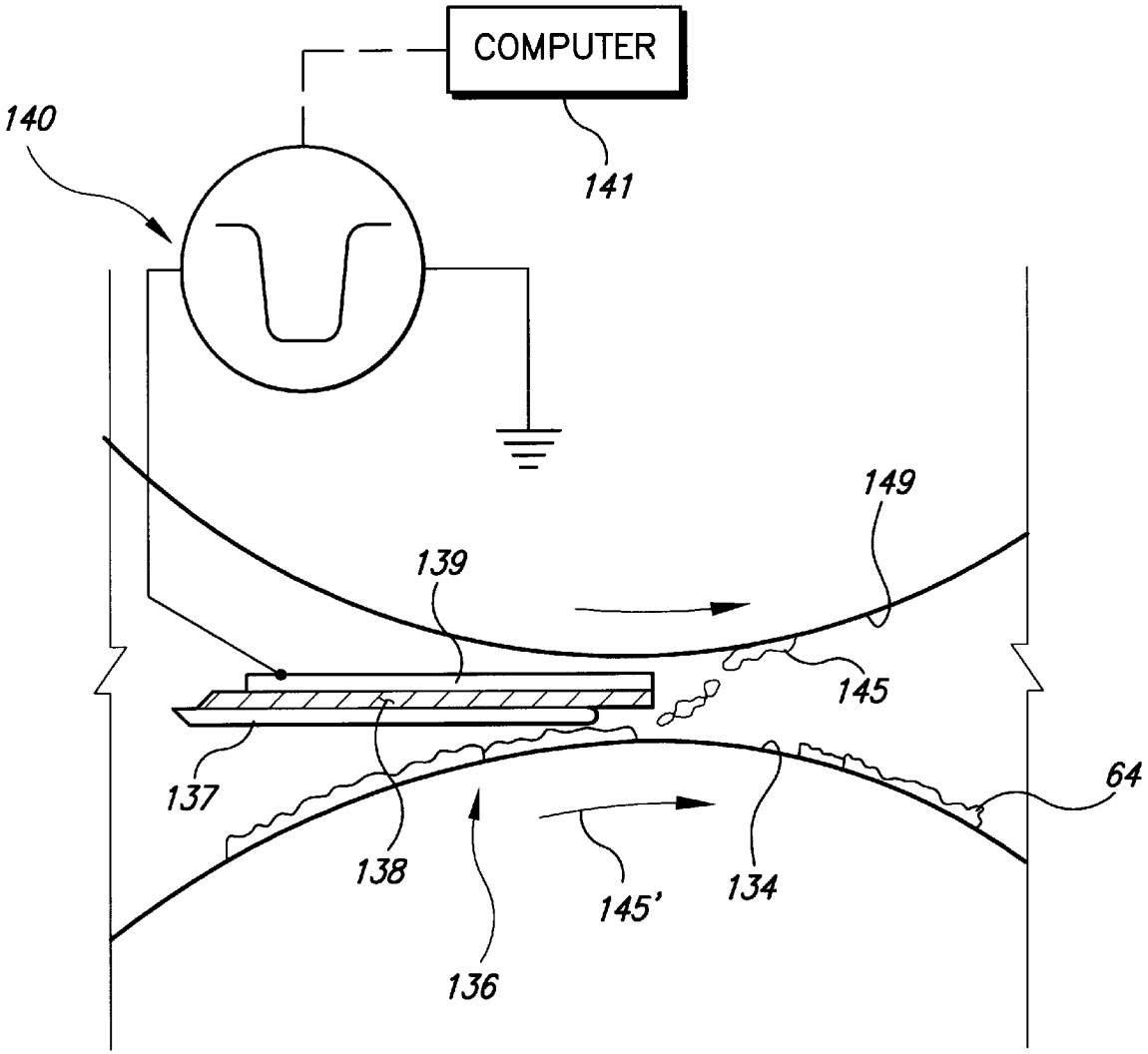
FIG. 7 is a detail side view of the primary electrode and related components of the apparatus of FIG. 6.

In the FIGS. 6 and 7 embodiment, components essentially identical to those in the FIGS. 3 and 4 embodiment are shown by the same reference numeral, whereas components only comparable are shown by the same numeral only preceded by a "1".

In the FIGS. 6 and 7 embodiment, the first roller 133 rotates in the direction 145' opposite the direction 45', and there is no primary electrode directly associated therewith. Rather the primary electrodes, illustrated schematically at 136 in FIG. 6, and seen more clearly in FIG. 7, are mounted between the rollers 133, 148. When the field is generated to create an image by computer 141 control of the electronic switches 140 associated with each of the pins or styluses 139, the image 145 is caused to be lifted from the roller 133 surface 134 onto the roller 148 surface 149, while the "background" toner remains on the surface 134 as illustrated at 64 in FIG. 7. An actual electrical field analysis of the configuration of primary electrodes 136 and rollers 133, 148 illustrated in FIGS. 6 and 7 was done with a finite element analysis package called "ELECTRO". This demonstrated that the electrodes 136 can develop a field of over 2.3 volts/$\mu$M at the surface 134, enough to overcome the electrostatic adhesion force on the toner particles on the surface 134. Once the toner images 145 are transferred to the surface 149 they are applied to the web 46 in the same way as described with respect to FIG. 3 except that the direction 154 is opposite the direction 54.

Figure 8:
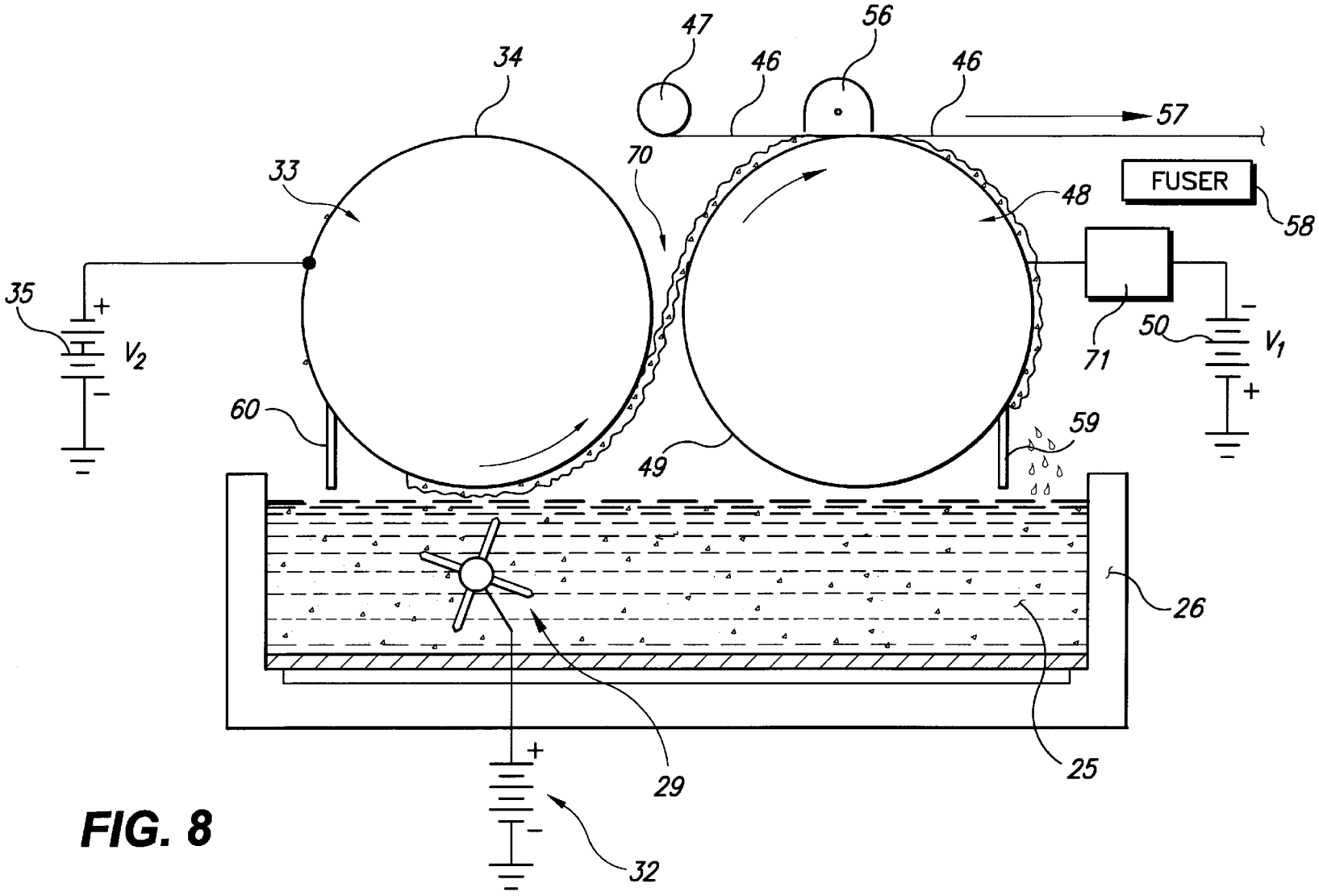
FIG. 8 is a view like that of FIG. 3 for still another embodiment.

FIG. 8 illustrates another embodiment with components comparable to those in the FIG. 3 embodiment shown by the same reference numeral. In this embodiment there is no array of pin or stylus electrodes, but rather transfer is provided between the surfaces 34, 49 at the gap 70 therebetween basically in bulk, electronic switch 71 being controlled to selectively connect the voltage source 50 to the roller 48 to cause transfer, or disconnect it to preclude transfer. When transfer is desired, images (typically in the form of lines) are transferred to the surface 49 and they are then brought into contact with the substrate 46. If desired, the roller 48 could be constructed of a plurality of conductive rings (at least on the surface 49 thereof) separated by insulators, with a different switch 71 associated with each ring.

It will thus be seen that according to the present invention an advantageous method and apparatus for field effect toning are provided. The invention allows direct-to-paper imaging utilizing very simple components, with no wearing parts, and with the only consumable being the toner itself. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and devices.

What is claimed is:

1. A field effect imaging apparatus, comprising:

an electrostatic fluidized bed of non-conductive, non-magnetic toner particles;

means for mounting a moving substrate on which toner is to be applied;

means for electrically charging toner particles in the fluidized bed;

a first roller having a conductive outer surface mounted for rotation adjacent the fluidized bed to receive charged toner particles from the fluidized bed in a layer on said surface;

an array of primary electrodes;

means for selectively applying electrical potential, or no electrical potential, to individual electrodes of said primary electrodes to provide a no-write or write condition thereby to effect removal of toner particles from said first roller in response to applying said electrical potential to selected individual electrodes in said no-write condition and leave toner particles on said first roller in response to applying no electrical potential to selected individual electrodes in said no-write condition; and means for transferring toner from said first roller to a moving substrate mounted by said means for mounting a moving substrate.

2. Apparatus as recited in claim 1 wherein said array comprises an array of pin or stylus electrodes, and wherein said array is mounted adjacent but spaced from said first roller and between said fluidized bed and said means for mounting a moving substrate.

3. Apparatus as recited in claim 1 wherein said means for transferring toner from said first roller to a moving substrate comprises a second roller having a conductive exterior surface.

4. Apparatus as recited in claim 3 wherein said array comprises an array of pin or stylus electrodes mounted adjacent but spaced from said first roller and remote from said second roller, so that said write and no-write conditions exist in association with said first roller.

5. Apparatus as recited in claim 3 wherein said array comprises an array of pin or stylus electrodes, and wherein said array is mounted between said first roller and said second roller and positioned so that said write and no-write conditions exist as toner is being transferred between said first roller and said second roller.

6. Apparatus as recited in claim 1 wherein said selectively applying means comprises an electronic switch associated with each primary electrode, and controlled by a computer.

7. Apparatus as recited in claim 1 wherein said means for transferring toner from said first roller to a moving substrate comprises means for transferring toner directly from said first roller to a moving substrate.

8. Apparatus as recited in claim 7 wherein said means for transferring toner further comprises a transfer corona mounted on an opposite side of a moving substrate from said first roller.

9. Apparatus as recited in claim 1 wherein said array comprises an array of pins or styluses; and wherein said pins or styluses of said array are mounted so that they are spaced about 75–125 microns from said first roller.

10. Apparatus as recited in claim 1 further comprising a flow shield for causing toner removed by each of said no-write condition of said primary electrodes to fall back into said fluidized bed.

11. Apparatus as recited in claim 1 wherein said means for electrically charging toner particles in the fluidized bed comprises a rotating cylinder with a plurality of corona points thereon and immersed in said fluidized bed.

12. A field effect imaging apparatus, comprising:

means for mounting a moving substrate;

a source of charged toner particles;

a first roller having a conductive outer surface mounted for rotation adjacent said source to receive charged toner particles from said source in a layer on the surface thereof;

an array of pin or stylus primary electrodes;

means for selectively applying electrical potential, or no electrical potential, to said individual pin or stylus primary electrodes to provide a no-write or write condition thereby to effect removal of toner particles from said first roller in response to applying said electrical potential to selected individual electrodes in said no-write condition and leave toner particles on said first roller in response to applying no electrical potential to selected individual electrodes in said no-write condition; and means for transferring toner from said first roller to a moving substrate mounted by said means for mounting a moving substrate.

13. Apparatus as recited in claim 12 wherein said pins or styluses of said array are mounted so that they are spaced about 75–125 microns from said first roller.

14. Apparatus as recited in claim 12 wherein said means for transferring toner from said first roller to a moving substrate mounted by said means for mounting a moving substrate comprises a second roller having a conductive exterior surface.

15. Apparatus as recited in claim 14 wherein said array of pin or stylus electrodes is mounted adjacent but spaced from said first roller and between said first roller and said second roller, so that write and no-write conditions exist in association with said first roller.

16. Apparatus as recited in claim 14 further comprising an electrical shield positioned between said first roller and said second roller, for preventing premature transfer of toner from said first roller to said second roller.

17. Apparatus as recited in claim 12 wherein said first roller conductive exterior surface is coated with or comprises a conductive hard metal coating.

18. Apparatus as recited in claim 17 wherein said exterior surface of said first roller is a coating of hard chrome and tungsten carbide.

* * * * *